US005567226A

United States Patent [19]

Lookman et al.

[11] Patent Number: 5,567,226

[45] Date of Patent: Oct. 22, 1996

[54] APPARATUS AND METHOD FOR ENHANCING THE PERFORMANCE OF A PARTICULATE COLLECTION DEVICE

[76] Inventors: Aziz A. Lookman, Apt. 5, 4 Bayard Rd., Pittsburgh, Pa. 15213; Roger W. Glickert, 1757 Q St., Apt. E, Washington, D.C. 20029; James E. Gabrielson, 2741 Comstock La., Plymouth, Minn. 55447

[21] Appl. No.: 338,362

[22] Filed: Nov. 14, 1994

Related U.S. Application Data

[63] Continuation of Ser. No. 958,994, Oct. 9, 1992, abandoned.

[51] Int. Cl.[6] ..... B03C 3/013

[52] U.S. Cl. ..... 95/3; 95/58; 96/52; 96/53; 96/74; 110/345; 423/243.06

[58] Field of Search ..... 95/58, 3, 8; 423/243.06; 422/186.04; 96/52, 53, 74; 110/345; 55/259, 261, 361, 341.1

[56] References Cited

U.S. PATENT DOCUMENTS

| | | | |
|---|---|---|---|
| 1,291,745 | 1/1919 | Bradley | 55/5 X |
| 2,356,717 | 8/1944 | Williams | 55/5 X |
| 3,523,407 | 8/1970 | Humbert . | |
| 3,665,676 | 5/1972 | McKewen | 55/122 X |
| 3,782,905 | 1/1974 | Huang et al. | 55/5 X |
| 4,042,348 | 8/1977 | Bennett et al. | 55/5 |
| 4,043,768 | 8/1977 | Bennett et al. | 55/5 |
| 4,064,219 | 12/1977 | Yamashita et al. | 423/545 |
| 4,070,424 | 1/1978 | Olson et al. | 55/5 X |
| 4,319,890 | 3/1982 | Teller et al. | 55/5 X |
| 5,029,535 | 7/1991 | Krigmont et al. | 110/345 |
| 5,034,036 | 7/1991 | Miller et al. | 55/385.3 |
| 5,122,162 | 7/1992 | Krigmont et al. | 95/2 |

OTHER PUBLICATIONS

Reese, et al., "Experience with Electrostatic Fly–Ash Collection Equipment Serving Steam–Electric Generating Plants", *JAPCA*, Aug., 1968, pp. 523–528.

Dismukes, "Conditioning of Fly Ash with Ammonia", *JAPCA*, Feb., 1978, pp. 152–156.

Oglesby, et al., *Electrostatic Precipitation*, Marcel Dekker, Inc., 1978, pp. 132–156.

Gallaer, *Electrostatic Precipitator Manual*, EPRI CS–2809, 1983.

Letter to Scott Rodgers (Duquesne Light Co.,) from Roger Glickert (Energy Systems Associates) dated Jul. 22, 1991.

Letter to Scott Rodgers (Duquesne Light Co.,) from Roger Glickert (Energy Systems Associates) dated Aug. 8, 1991.

*Primary Examiner*—Richard L. Chiesa
*Attorney, Agent, or Firm*—Dickie, McCamey & Chilcote, P.C.; Leland P. Schermer, Esq.; John N. Cox, Esq.

[57] ABSTRACT

The present invention provides an apparatus and method to improve the performance of a variety of particulate collection devices. Gaseous ammonia is injected by one or more injectors into a waste gas upstream from a particulate collection device. The amount of ammonia injected from each injector is controlled so that the local concentration of ammonia in the waste gas is approximately the same as the corresponding local concentration of sulfur trioxide in the waste gas. The flow of ammonia from each injector is controlled by measuring several local sulfur trioxide concentrations in the waste stream after the ammonia has been injected. The sulfur trioxide can occur naturally or result from injection. By keeping the concentration of ammonia approximately equal to the concentration of sulfur trioxide, ammonia and sulfur trioxide react to form a liquid product. This liquid reaction product coats the surfaces of particles entrained in the gas stream. Once coated, the particles' electrical conductivity is altered so that they are more easily collected by devices employing electrostatic attraction. The liquid coating also causes the particles to agglomerate and these larger agglomerates are easier to collect.

19 Claims, 4 Drawing Sheets

APPARATUS AND METHOD FOR ENHANCING THE PERFORMANCE OF A PARTICULATE COLLECTION DEVICE

This application is a continuation of application No. 07/958,994, filed Oct. 9, 1992, now abandoned.

BACKGROUND OF THE INVENTION

1. Field of the Invention

The present invention relates to an apparatus and method for enhancing the performance of particulate collection devices. In particular, the present invention relates to the use of ammonia injection apparatus and methods that optimize the ammonia injection to increase the efficiency of particulate removal from waste gases.

2. Description of the Prior Art

Apparatus and methods for the removal of particulate from waste gases is known to be desirable. For example, in the combustion of fuels, in particular coal, various undesirable materials are released into the flue gas and are thereby released to the atmosphere. Among these are sulfur dioxide, sulfur trioxide, carbon monoxide, nitrogen oxides, and particulates. Particulate emissions are increasingly subject to legal limitations in terms of pounds per million Btu input, pounds per unit time, and in terms of the opacity of the Stack effluent. To meet these limits, and at times to reduce emissions for other reasons, various particulate collection devices have been employed by the operators of the combustion devices. Electrostatic precipitators, baghouses, cyclones, scrubbers, mechanical collectors, filter beds, electrified filter beds and other devices have been used to remove fly ash from the flue gases.

The most common particulate removal device employed by operators of the largest boilers is an electrostatic precipitator. U.S. Pat. Nos. 5,029,535 and 5,122,162 to Krigimont, et al. disclose a precipitator. *Electrostatic Precipitation*, by Oglesby and Nichols, Marcel Dekker, Inc., New York 1978, provides a good background on the subject. See also U.S. Pat. No. 3,523,407 to Humberg, and the *Journal of the Air Pollution Control Association*, Volume 18, No. 8, "Experience With Electrostatic Fly-Ash Collection Equipment Serving Stem-Electric Generating Plants," pp. 523, et seq., Reese and Greco, August 1968.

An electrostatic precipitator typically operates with a great number of wires which are charged negatively to as high as 60,000 volts and a number of grounded plates which are, of course, neutral. The particulate-laden gas passes horizontally between parallel plates which may be 9 inches apart, 20 feet high and 20 feet long. A field may consist of up to 40 of such parallel plates with as many as five fields in series in a precipitator. Between each adjacent plate are many wires. Each plate is grounded and each wire is charged negatively. The wires in each field may all be charged from a single source or the fields may be "sectionalized" in which each of two or more bus sections per field are energized by a separate source. Electrons are emitted from the wires and they ionize the gas immediately surrounding the wires developing a corona discharge, which is a rapid flow of ions. In the electrostatic field between the highly negatively charged wires and the grounded plates, the negatively charged ions are forced toward the grounded plates. Along the way, many of them collide with and become attached to the ash particles suspended in the gas stream. Then the particles become charged and, under the influence of the electrical field, migrate toward the collection plates. The magnitude of the force causing the particles to move toward the plates is proportional to the field strength and the charge on the particles. These particles arrive at the collection plate and are held there by a combination of mechanical, electrical, and molecular forces. The collected particles are removed by rapping the collection plates on a periodic basis. A thick layer of particulate matter must be collected so that it falls into the hopper as large agglomerates, so as to prevent excessive re-entrainment of the material into the gas stream.

The electrical field in an electrostatic precipitator exists from the wire to the plates. It exists through the collected ash layer. The average field strength is the voltage divided by the distance from wire to plate. If the potential is 60,000 volts and the wire to plate distance is 4.5 inches (11.43 cm) the average field strength is 5250 volts/cm. If the fly ash resistivity is too high the field strength is much greater in the accumulated fly ash layer. If the voltage gradient exceeds 15–20,000 volts/cm the fly ash break down and an arc occurs between the plate and the wire at the breakdown point. Current flows through the ionized gas at this point and no useful power is supplied to the bus section connected to the offending wire. This bus section is then automatically shut down and automatically restarted at a lower, but gradually increasing, voltage. This process retards the cleaning action of the precipitator and more fly ash goes out the stack with the flue gas. The fly ash is essentially glassy spheres containing the ash constituents of the coal mixed with unburned carbon. The chemical compositions of the glass spheres vary widely, depending on the source of the coal.

Fly ash is not very conductive. It may typically have resistivities as high as $10^{13}$ ohm-cm at the temperature where it is most resistive as shown in FIG. 1. The resistivity is lowered if the temperature is increased because the glass spheres are semi-conductors and are, therefore, more conductive at higher temperatures. Some electrostatic precipitators which were designed to operate on low sulfur western subbituminous coals were designed to take advantage of this fact by operating at 450 degrees F. or higher.

Many precipitators operate at temperatures below the temperature corresponding to the maximum resistivity. The lowering of the resistivity at the lower temperatures is naturally caused by condensation of sulfuric acid on the fly ash surface. The sulfuric acid is formed from sulfur trioxide and water vapor in the flue gas. At typical temperatures of 240 to 350 degrees F., the fly ash can usually be conditioned when there is 3 to 30 ppm of sulfur trioxide in the flue gas. The sulfur in coal is substantially converted to sulfur dioxide during Combustion. However, 0.2% to 2% of the sulfur in fuel is converted to sulfur trioxide in the furnace. This is the natural source of the conditioning agent that improves precipitation performance at 250 to 350 degrees F.

Many boiler operators are converting to lower sulfur coals in order to reduce sulfur dioxide emissions. If a boiler burns coal that has a sulfur dioxide emission potential of 1.2 lbs. sulfur dioxide per million BTU's, the flue gas will have about 600 ppm of sulfur dioxide if the gas is only slightly diluted with air and, at a conversion fraction of 1%, there would be only 6 ppm of sulfur trioxide in the flue gas. This is typically not enough to condition the fly ash and make it sufficiently conductive for good electrostatic precipitator performance unless the temperatures are extremely low, as a large fraction of the sulfur trioxide produced reacts with active sodium and calcium ions, making that fraction unavailable for fly ash conditioning. Many boiler operators have encountered this problem when switching to low sulfur coals.

Some operators have used sulfur trioxide conditioning to abate this problem. They add sulfur trioxide in the flue gas in amounts of 3 to 30 ppm in order to reduce the resistivity of the fly ash and improve the precipitator performance. This is an expensive process requiring corrosion resistant materials, multiple introduction points, a catalytic system to convert sulfur dioxide to sulfur trioxide, and storage and handling of liquid sulfur dioxide or burning of sulfur. In addition, when the boiler is operating at part load, the sulfur trioxide concentration may become too high and the resulting sulfuric acid can corrode the back end of the steam generator system. In addition some fly ash has a surface that is not easily coated by sulfuric acid and the problem of highly resistive fly ash can occur in spite of seemingly adequate levels of sulfur trioxide, either from high sulfur coals or conditioning systems.

Some operators have used ammonia conditioning systems. U.S. Pat. No. 4,064,219 to Yamashita, et al. discloses such a system as does U.S. Pat. No. 5,034,030 to Miller. See also *The Journal of Air Pollution Control Association*, Vol. 25, No. 2, "Conditioning of Fly-Ash With Ammonia," p. 152, Dismukes, February 1975. The success has been somewhat limited. Charles Gallaer in his Electrostatic Precipitator Reference Manual, EPRI CS-2809 published by Electric Power Research Institute, 1983, states > "Ammonia, NH3, has also been used to condition cold-side precipitators with uneven results. Although it cannot be shown to significantly reduce the resistivity of high resistivity fly ash, its use has helped some precipitators with this problem. It has been spectacularly successful in increasing the efficiency of precipitators handling fly ash of such low resistivity that they were "power hogs." In this latter application, it is presumed to react with the excess SO3 to form ammonium sulfate. This reaction not only increases the resistivity of the fly ash, but produces a fume having a large surface area. This fume, through its space charge effect, causes the precipitator to operate at a higher voltage and, therefore, to have a better performance.
>
> However, the reason why ammonia sometimes does and sometimes does not alleviate cold-side resistivity problems is still not completely understood".

Thus, it is seen that electrostatic precipitators sometimes do not operate well due to the high resistivity of the fly ash, that this problem is exacerbated by the continuing switch to low sulfur coal, that fly ash sometimes has a surface that retards the desirable action of the sulfuric acid, that sulfur trioxide conditioning is expensive, difficult and may damage parts of the combustion device, and that ammonia addition, as now practiced, is not always effective and sometimes actually increases fly ash resistivity which, while it may be desirable in the "power hog" case, is counterproductive when the problem is the more common highly resistive fly ash problem.

For the most recent few years baghouses have generally been the fly ash collection device of choice when a new unit is being designed to burn coal which will produce highly resistive fly ash. However, some baghouses operating on very resistive fly ash have not performed well. Too much of the fly ash passes directly through the bags. Also, with high resistivity ashes, it is difficult to clean the bags. The high resistivity ash, once it picks up an electrostatic charge, stays charged for long periods of time and firmly sticks to the bag by electrostatic and/or other forces. Cyclones, another particulate collection device, can be used as a scalping device to remove larger particulates prior to treatment of the flue gas by electrostatic precipitators or baghouses. Cyclones are relatively insensitive to resistivity of particulates, but are very sensitive to particle size.

SUMMARY OF THE INVENTION

In accordance with the present invention there is provided an improved apparatus and method for enhancing the performance of a particulate collection device, such as electrostatic precipitators, baghouses and other particulate collecting devices. Flue gas is produced when coal or other carbonaceous materials are combusted with air and much of the heat produced by the chemical reactions in the combustion process is removed to produce steam, or to heat process materials, to do other useful work, or where the heat is removed as a waste product as may be the case in the incineration of undesirable materials. The flue gas is mainly nitrogen, carbon dioxide, oxygen, and water vapor, but it also contains the inorganic particulates which remain after the carbonaceous material is consumed by the combustion, and it may contain some carbonaceous material which was not burned. At the temperature of the flue gas in the collection device, the fly ash may be too resistive or too small in size for optimum performance of the collection device.

In order to improve the performance of the collection device, a source of gaseous ammonia is added to the waste gas (such as flue gas) in amounts roughly equivalent to the gaseous sulfur trioxide in the flue gas. The amount of ammonia is generally held below the gaseous sulfur trioxide concentrations on a mole or parts per million basis. A manifold is used with the apparatus to receive a primary gaseous ammonia flow from said source of gaseous ammonia. The manifold splits the primary gaseous ammonia flow into a plurality of secondary gas ammonia flows. The gaseous ammonia is introduced through one or more injectors such as pipes, tubes or nozzles, upstream of the collection device through which the waste gases pass. Said one or more injectors are located in a position to introduce said secondary gaseous ammonia into said waste gases.

The gaseous sulfur trioxide concentrations are determined at various locations by one or more sensing devices such as direct chemical or instrument measurements, indirectly by dew point measurements, or by inference by measuring other related parameters. One or more control valves are used to control the secondary gaseous ammonia flows to said one or more injectors. The control valves are activated by one or more controllers which receive the output signals of said one or more sensing devices. The output signals are based upon the concentration of said gas-phase sulfur trioxide. The controllers generate control signals, which in turn adjust one or more of said control valves, such that said secondary gaseous ammonia flows from one or more of said injectors maintain the downstream concentration sulfur trioxide at an optimum level. The ammonia injection profile can, if necessary, be adjusted to follow the sulfur trioxide profile. The addition can be done upstream of the collection device, or within the collection device. The ammonia injection may be in conjunction with a sulfur trioxide injection system but, in any case, the ammonia is held below the gaseous 'sulfur trioxide concentration or the expected aggregate gaseous downstream sulfur trioxide concentration if additional sulfur trioxide is injected.

Because of the simplicity of this system, which relies only on the introduction of ammonia in molar amounts substantially not greater than total molar amounts of the gaseous sulfur trioxide and which can be optimized by determining the local gaseous sulfur trioxide concentrations and patterning the ammonia rates to follow these concentrations, it can be easily used to improve electrostatic precipitator and other particulate collection device efficiencies. The technique of finding the gaseous sulfur trioxide and controlling the ammonia near or below this level is critical to producing reaction products that are liquid at the temperature of the waste gas. Liquid reaction products have lower dew points at a specific water vapor concentration, have higher solubility, and are more conductive than solid reaction products. The liquid reaction products agglomerate the fly ash particles better and improve the conductivity. The measuring of and following of sulfur trioxide concentration allows the use of more ammonia and, thus, better conditioning without producing the less desirable solid reaction products that occur when there is an excess of ammonia over sulfur trioxide on a molar basis.

It is an object of the present invention to provide an apparatus and method for enhancing the performance of a particulate collection device.

It is a further object of the present invention to provide ammonia injection apparatus and methods that optimize the ammonia injection to increase the efficiency of particulate removal from waste gases.

It is yet a further object of the present invention to maximize the efficiency of ammonia injection using the least possible amount of ammonia.

It is still a further object of the present invention to provide an apparatus and method that controls the rate of ammonia injection at any point in a waste gas duct based upon the variations downstream of the ammonia injection location.

It is still another object of the present invention to add ammonia to a waste gas stream in such a manner as to preferentially create liquid reactants instead of solid reactants.

Still another object of the present invention is to provide an apparatus and method to enhance the performance of particulate removal devices by agglomerating waste gas particulates and/or by reducing their resistivity.

These and other objects will be more fully understood by reference to the drawings and detailed description provided herein.

DETAILED DESCRIPTION OF THE PREFERRED EMBODIMENT

Figure 1:
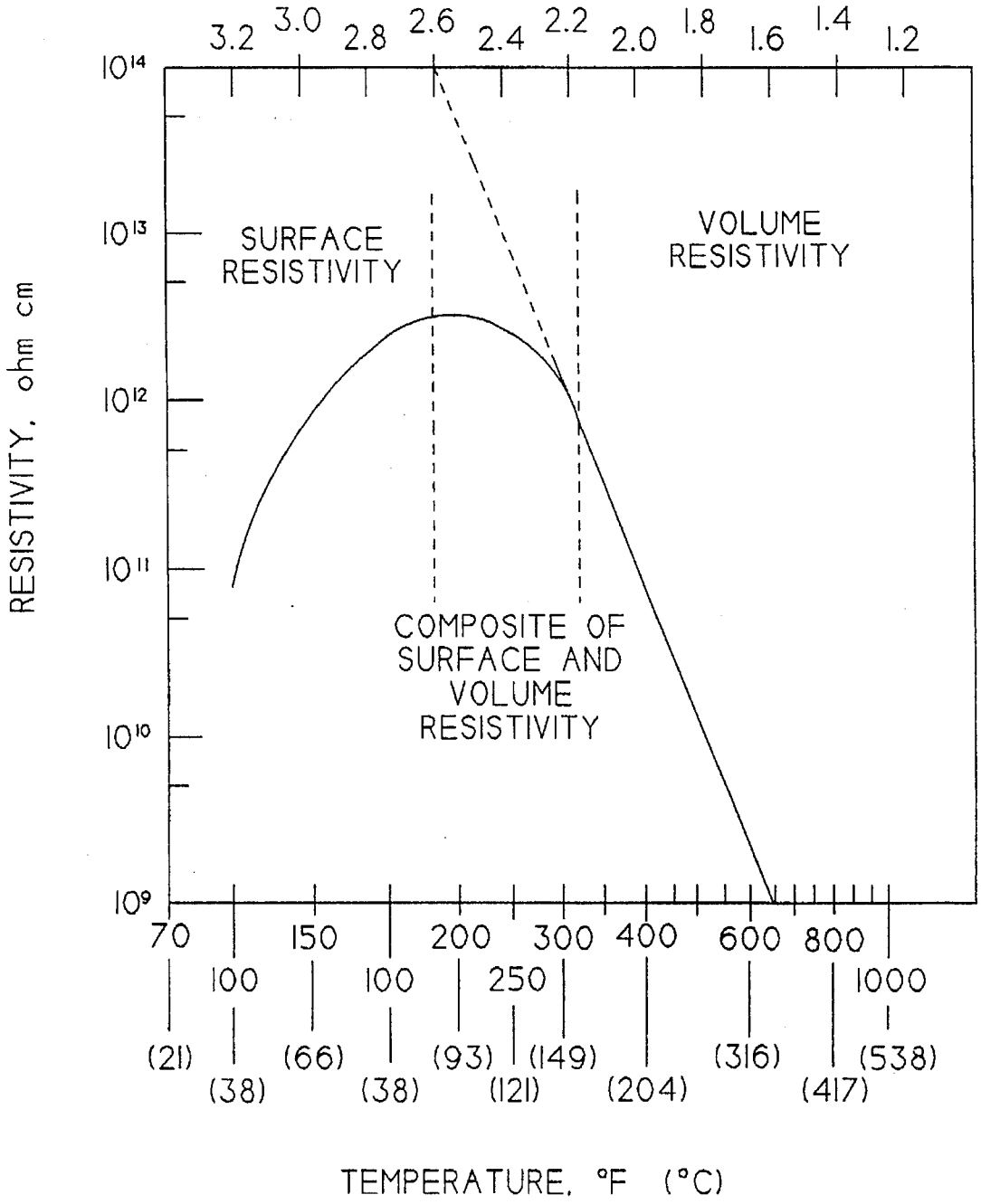
FIG. 1 shows a graph of Typical Fly Ash Resistivity as a function of temperature.

FIG. 1 shows a graph of typical fly ash resistivity as a function of temperature. FIG. 1 shows the dependency of resistivity on temperature. Resistivity of fly ash is at its lowest at temperature where it is impractical to operate a cold-side precipitator.

Figure 4:
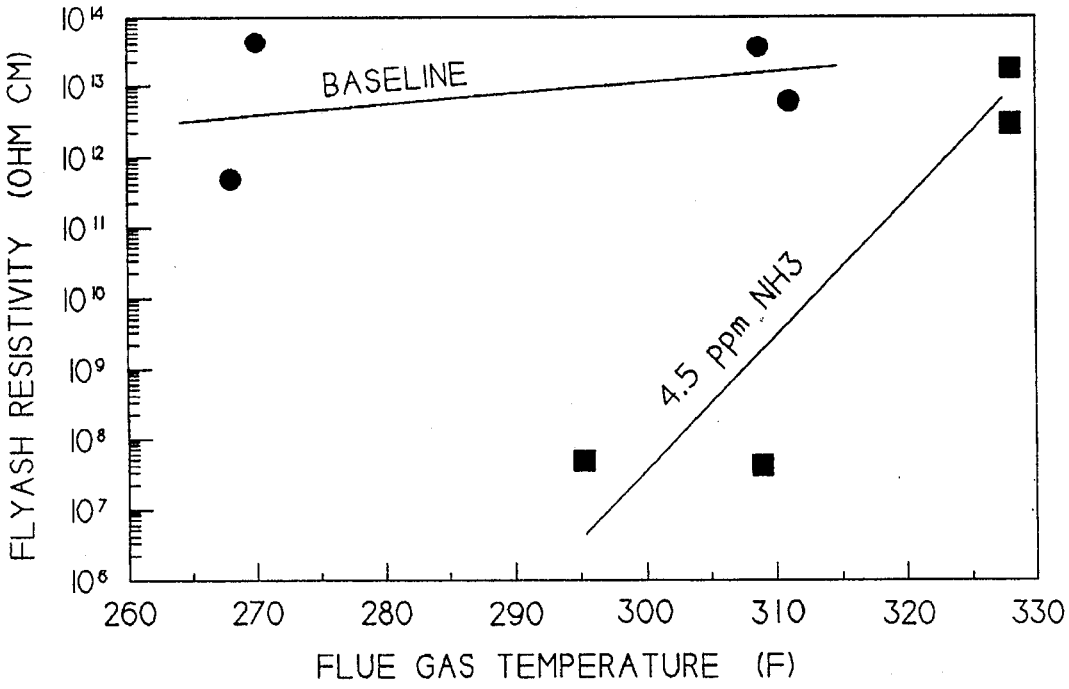
FIG. 4 shows a graph on the effect of ammonia injection on in-situ fly ash resistivity.

FIG. 4 shows the impact of ammonia addition on the resistivity of fly ash.

Figure 5:
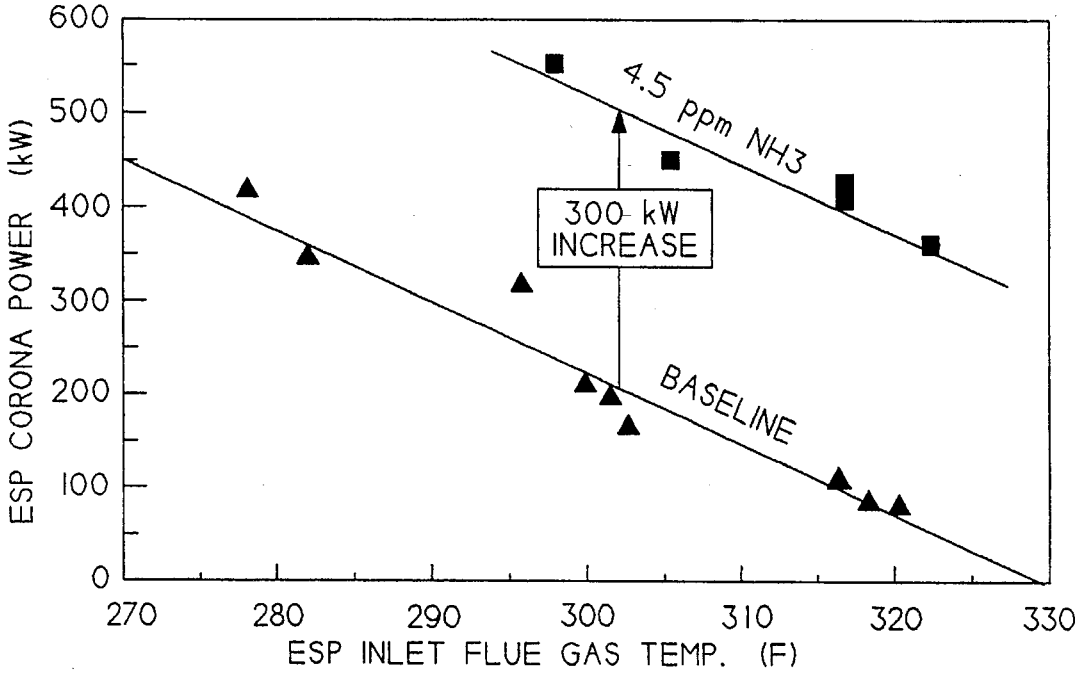
FIG. 5 shows a graph on the effect of ammonia injection on ESP Corona Power.

FIG. 5 shows the impact of ammonia addition on the performance of an electrostatic precipitator as measured by corona power.

Figure 6:
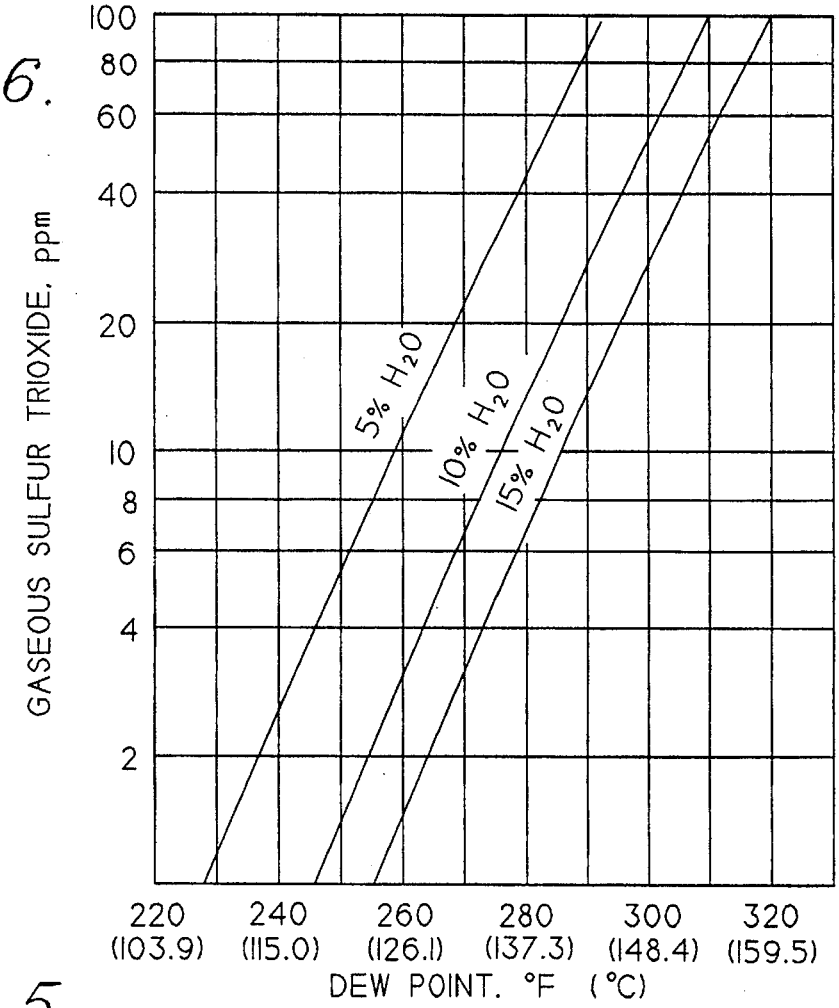
FIG. 6 shows acid dew points at various moisture concentrations.

FIG. 6 shows how gas-phase sulfur trioxide concentration can be calculated from acid dew point temperature and water vapor concentration.

Figure 2:
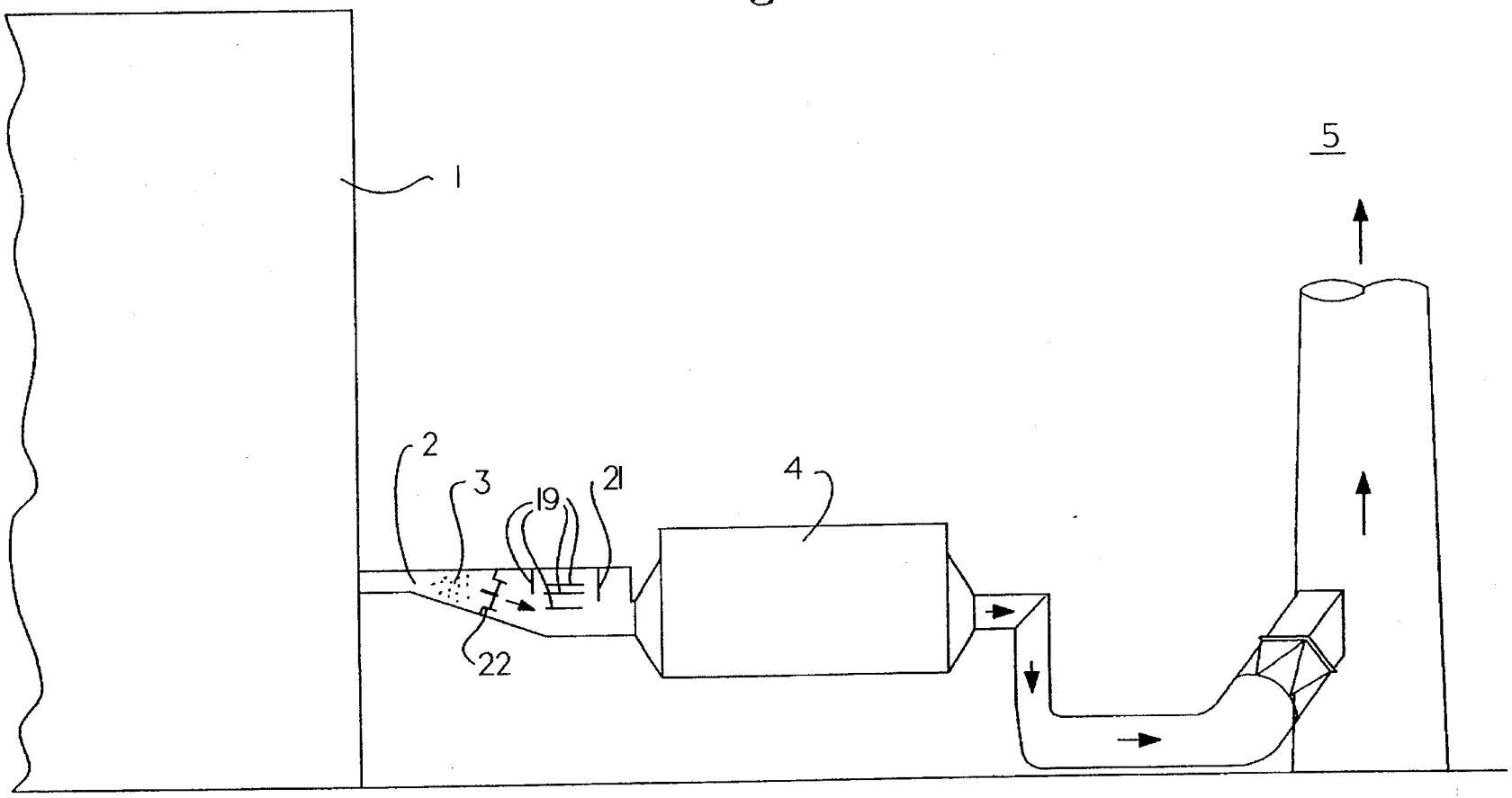
FIG. 2 shows an apparatus for enhancing the performance of a particulate collection device.
Figure 3:
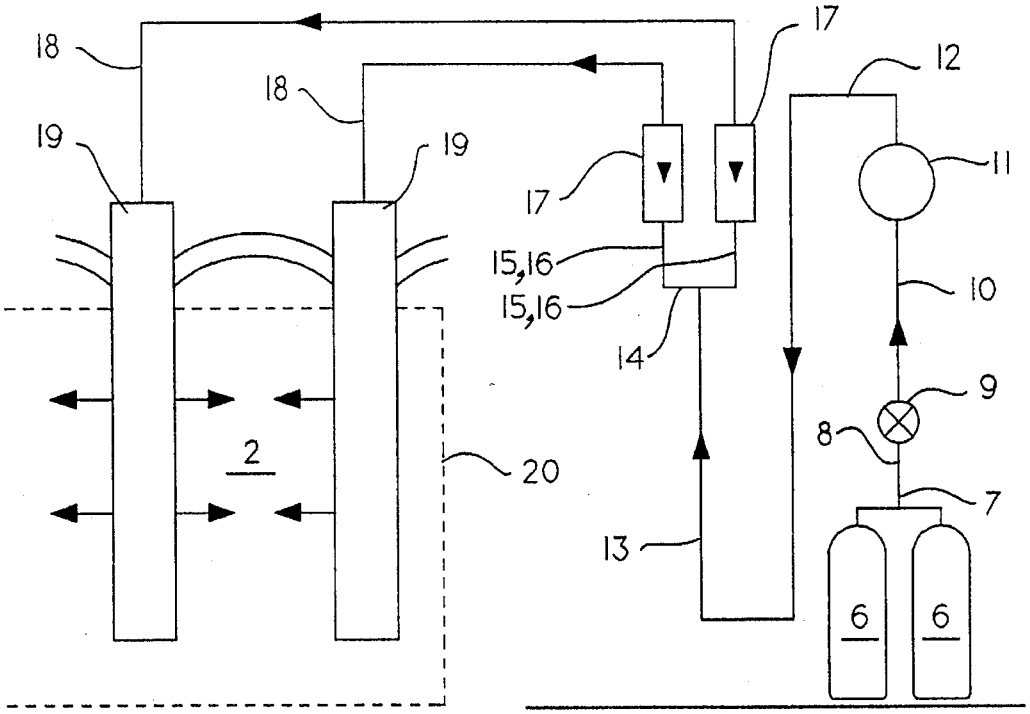
FIG. 3 shows a schematic of an ammonia injection system.

The present invention will be described in further detail by way of a preferred embodiment, particularly as shown in FIGS. 2 and 3.

Referring to FIGS. 2 and 3, a source of a waste gas 1 is shown. The waste gas itself 2 contains particulate matter 3 that must be removed with a particulate collection device 4 prior to said waste gas 2 being discharged into the atmosphere 5. Said source of waste gas 1 could be any type industrial device that generates an exhaust gas that is contaminated with particulate matter. One common type of device that generates waste gas is a combustion device. Steam generators, cement kilns, heaters and incinerators are examples of combustion devices. Many types of fuels that are burned to generate steam or heat contain non-combustible components that may become entrained in the waste gas created by combustion. Other types of combustion devices are used to incinerate materials or to create a high temperature reaction zone for materials. In these devices, materials being incinerated or reacted may be swept out of the incineration or reaction zone with the waste gas created by combustion.

The present invention relates an improved apparatus and method for enhancing the performance of a particulate collection device by injecting ammonia into said waste gas 2 for the purpose of improving the efficiency of a particulate collection device 4. The ability of any given particulate collection device to remove particulate matter from a waste gas is dependant on the type of collection device and the characteristics of the particulate matter. In some situations, decreasing the resistivity of the particulate matter and increasing the average particulate size have the effect of increasing the efficiency of the particulate collection device.

A source of ammonia may contain either a gaseous or liquified ammonia. If liquified, a heating means (not shown) must be supplied to gasify said ammonia. From a source of gaseous ammonia 6, a primary gaseous ammonia flow 7 is transferred through pipe 8 to primary control valve 9. From primary control valve 9 pipe 10 transfers said primary gaseous ammonia flow 7 to a pressure regulator 11. Said primary gaseous ammonia flow 7 can be diluted with a carrier gas. Examples of a carrier gas which can be used for this purpose are air, nitrogen, carbon dioxide, helium and argon.

From pressure regulator 11, pipe 12 carries primary gaseous ammonia flow 13 to a manifold 14. Manifold 14 splits the primary gaseous ammonia flow 13 into one or more secondary gaseous ammonia flows 15. FIG. 3 shows two secondary gaseous ammonia flows 15, however, the present invention is not restricted to any particular number.

One or more pipes 16 carry said secondary gaseous ammonia flows 15 to one or more secondary control valves 17. One or more pipes 18 carry the one or more secondary gaseous ammonia flows 15 to one or more injectors 19. Injectors 19 are located so that they inject said secondary gaseous ammonia flows 15 into waste gas 2.

Preferably, injectors 19 are located on an inside surface of a waste gas duct 20. Said waste gas duct 20 contains said waste gas 2 while said waste gas travels from said source of waste gas 1 to said particulate collection device 4. More preferably, injectors 19 are located so they inject secondary gaseous ammonia flows into a plurality of pre-determined locations in the interior of waste gas duct 20.

Downstream from injectors 19 are one or more sensing devices 21. The purpose of sensing devices 21 is to provide an indication of a concentration of gas-phase sulfur trioxide remaining in waste gas 2 after secondary gaseous ammonia flows 15 have been injected. The concentration of gas-phase sulfur trioxide can be determined in several ways. Preferably, sensing devices 21 contain an acid dew point temperature sensing probe, a flue gas temperature probe, a water vapor probe for determining water vapor concentration, and a means for combining the outputs of the acid dew point, temperature, and water vapor probes. Sensing devices 21 generate one or more output signals that are based upon gas-phase sulfur trioxide concentration.

FIG. 6 shows the general relationship between acid dew point temperature, water vapor concentration, flue gas temperature, and gas-phase sulfur trioxide concentration. However, other direct measurements of gas-phase sulfur trioxide measurement are available, such as photometric techniques. One or more outputs are transmitted over a line from sensing devices 21 to one or more controllers.

Preferably, sensing devices 21 determine the gas-phase sulfur trioxide concentration in a plurality of locations in waste gas 2. One or more controllers receive output signals and derive a gas-phase sulfur trioxide distribution. Distribution data points can be used to estimate gas phase sulfur trioxide concentration within the vicinity of sensing devices 21.

One or more controllers controls the ammonia flow to ensure that the gas-phase sulfur trioxide concentration downstream of the ammonia injection location is negligible for a majority of the flue gas. The one or more controllers will generate control signals to adjust one or more of said control valves 9 and/or 17 such that said secondary gaseous ammonia flows 15 from said one or more injectors 19 maintain the downstream concentration of sulfur trioxide at an optimum level. For each area downstream of the ammonia injection location, corresponding to the injectors 19 controlled by a particular secondary control valve 17, the flow rate through that control valve is increased if the sulfur trioxide concentration for that area is estimated to be substantially greater than zero, and reduced of said concentration is expected to be zero.

Alternatively, the secondary control valves 17 can be set at a particular set of operating conditions, the setting being selected to insure that the downstream gas-phase sulfur trioxide concentration is negligible for a majority of the duct. At conditions other than the set of operating conditions at which this setting was made, the ammonia flow is adjusted by simply decreasing or increasing flows by a fixed amount or by a fixed fraction of the set ammonia flow.

Secondary gaseous ammonia flows 15 disperse out of injectors 19 into waste gas 2. "Spray nozzles 22 can also be employed upstream of said one or more injectors." When in waste gas 2, gaseous ammonia reacts with sulfur trioxide to form waste reaction products. The exact composition of reaction products depends on how much ammonia reacts with sulfur trioxide. It is preferred that at any given point in waste gas 2, the local concentration of sulfur trioxide exceed the local concentration of ammonia that is available to react with sulfur trioxide. This excess of sulfur trioxide over ammonia favors the formation of reaction products that have a low melting point, so that reaction products are liquid at temperatures commonly found in waste gas ducts.

Liquid reaction products serve two purposes. First, liquid reaction products act to agglomerate particulate matter 3 into agglomerates. Second, liquid reaction products have a lower resistivity than particulate matter 3, so that the agglomerates have a lower resistivity than particulate matter 3. Because agglomerates are on average larger than the individual pieces of particulate matter 3, and because they have on average lower resistivity than particulate matter 3, they are more easily collected by particulate collection device 4.

Particulate collection device 4 is preferably an electrostatic precipitator. Particulate collection device 4 can also be a baghouse, a cyclone, a sand filter, a pebble filter, an electrified sand filter and an electrified pebble filter. This process improves the performance of electrostatic precipitators because the resistivity of the particles collected on the participator plates is reduced. The performance of any particulate collection device that separate solids on the basis of charging the solids will be improved by this invention. Also, because this process increases the average size of particles treated, the performance of all particulate collection device that separates solids on the basis of the size is improved. An alternate variation of this invention is employed when waste gas 2 has either no sulfur trioxide or insufficient sulfur trioxide. This situation could occur if a combustion device was-burning a fuel with a low sulfur content or a fuel with no sulfur. In order for this invention to work, there needs to be enough sulfur trioxide in waste gas 2 for the ammonia to react with and form reaction products that alter the size or resistivity of particulate matter 3. A flow of sulfur trioxide is transferred from a source of sulfur trioxide to a control valve. A line transfers sulfur trioxide flow to one or more sulfur trioxide injectors. Sulfur trioxide spray nozzles are used to provide additional sulfur trioxide flow into waste gas 3, at a location upstream from injectors 19.

An alternate variation of this invention uses one or more injectors 19 which are arranged non-uniformly around a duct through which waste gas flows, such as on the inside surface of waste gas duct 20. The non-uniform distribution of injectors 19 is to account for a non-uniform gas-phase sulfur trioxide concentration distribution. The non-uniform distribution of injectors 19 will group the injectors so that greatest number of injectors are located where the sulfur trioxide concentration is the highest.

In one variation of this invention, injector 19 is a pipe that extends out from the inside surface of waste gas duct 20. The pipe is closed on its distal end, and has a plurality of holes drilled into opposite sides of the pipe. The pipe is arranged so that the secondary gaseous ammonia flow 15 passes into it and is dispersed out of holes approximately perpendicular to the superficial flow of waste gas 2.

An alternative version of this invention employs an injector 19 that comprises a pipe with holes of a non-uniform size. Said holes are drilled to different sizes depending upon non-uniform distribution of gas-phase sulfur trioxide. The different sized holes result in an uneven distribution of secondary gaseous ammonia flow 15 from injector 19, so that larger quantities of ammonia are directed to the locations in waste where gas 2 there are high concentrations of sulfur trioxide.

The present invention comprises a method for enhancing the performance of a particulate collection device 4 comprising the steps of generating a primary gaseous ammonia flow 7 from an ammonia source 6, splitting said primary gaseous ammonia flow 7 into a plurality secondary gaseous ammonia flows 15, delivering said secondary gaseous ammonia flows 15 to one or more injectors 19, introducing said secondary gaseous ammonia flows 15 into waste gas 2, measuring a gas-phase sulfur trioxide concentration of said waste gas 2 in one or more locations downstream from said one or more injectors 19, generating one or more output signals that are based upon the measurement of said gas-phase sulfur trioxide concentration as in the measuring step, and controlling said secondary gaseous ammonia flows 15 from said one or more injectors 19 to maintain downstream concentration of sulfur trioxide at an optimum level. The most preferred optimum level is that level where the sulfur trioxide concentration approaches, but does not reach, zero. It should be understood, however, that larger concentrations can still comprise an optimum level so long as some reduction in sulfur trioxide concentration occurs or so long as particulate removal is enhanced to some degree.

EXAMPLE 1

A power plant with a single dual furnace Combustion Engineering steam generator and a turbine having a rating of 570 megawatts was experiencing derates due to the fact that the stack opacity was exceeding the legal limit. The opacity was high due to inadequate functioning of the electrostatic precipitator which was due to the high resistivity of the fly ash. The electrostatic precipitators had low power due to the high resistivity and thus were not adequately collecting the particles especially those in the critical size range for opacity, 0.2–2.0 micrometers. The derate is a reduction in output that reduces the flow through the unit and, thus, through the electrostatic precipitator, to a level where the efficiency is improved and the opacity is reduced to an acceptable level. The derate was 150 megawatts (MW) or about 25%. The replacement cost of a 150 MW power plant would be $100,000,000–225,000,000. Thus it is seen that this derate idles a very expensive accumulation of capital equipment. Eight injectors as described above were installed in one of two parallel ducts carrying the flue gas to two parallel electrostatic precipitators. This ammonia injection set up was on the B side. It was set to inject 3 ppm of ammonia. The acid dew point of 257 degrees F which the unit exhibited without ammonia injection would indicate an sulfur trioxide concentration of about 5 ppm. So, at an ammonia injection rate of 3 ppm, the mole ratio of ammonia to sulfur trioxide was well below unity. After 2–3 days of operating with ammonia injection on the B side, the B side precipitator corona power had risen while the A side precipitator corona power was essentially unchanged. More importantly, the plant had recovered about 50 MW (one third) of its opacity derate.

EXAMPLE 2

Immediately following the success illustrated in Example 1, an eight injector ammonia conditioning was also installed on the A side of the unit described there. Both systems were operated together at injection rates of 3 to 7 ppm of ammonia. After a series of trials, the average injection rate was set to result in an average concentration throughout the waste gas of approximately 4.5 ppm. However, the injection rates for the different injectors varied so as to locally result in concentrations of about 0.5 ppm to 10.0 ppm. At this injection rate the fly ash resistivity, at 310 degrees F., decreased from about $10^{13}$ for the unconditioned ash to $10^{9}$ for the ammonia conditioned ash, FIG. 4. This is an improvement of a fly ash from one that is very difficult for an electrostatic precipitator to handle to one on which an electrostatic precipitator can performquite efficiently. The corona power to the electrostatic precipitator (ESP) increased 300 kW, which at temperatures above 290 degrees F., was a 100% increase as shown in or more FIG. 5. This indicated the precipitator was operating much more efficiently. The opacity derates were not usually necessary with this treatment.

EXAMPLE 3

In the same plant as described in Examples 1 and 2, the acid dew point was measured using a dew point meter. The local ammonia flows were adjusted so the downstream gaseous sulfur trioxide was non-zero for a majority of the downstream flow. Remembering that the base line sulfur trioxide concentration was 5 ppm and the average ammonia injection was 4.5 ppm, it is easy to see how the local ammonia concentration could be well above the local sulfur trioxide concentration without the measurement and adjustment. This change improved the precipitator operation, reduced the amount of ammonia which was used, and probably reduced the emissions of the residual ammonia in the flue gas.

EXAMPLE 4

At the same power plant described in Examples 1, 2, and 3, with an ammonia injection device as described in Example 2, the operators found that with sulfur dioxide emissions below about 2.4 pounds per million Btu, the ammonia injection actually makes the opacity worse. Thus, it is seen again that the ammonia injection should not be too large in proportion to the sulfur trioxide concentration; this conclusion results from the previously noted fact that the sulfur trioxide is much lower but in proportion to the sulfur dioxide. This problem can probably be circumvented by operating at lower ammonia injection rates or by determining the sulfur trioxide concentration profile and adjusting the local ammonia injection rates.

Thus, we have shown that, in spite of previous confusing experience by others, fly ash with high resistivity can be treated with ammonia to reduce the resistivity and improve the operation of particulate collection devices. We have shown that this can be used to reduce opacity derates and the expense of these derates. The process has been shown to work best when the ammonia concentration is below the sulfur trioxide concentration. We have found a further improvement which involves measuring the sulfur trioxide concentration or acid dew point and adjusting the local ammonia injection rates so that the gaseous sulfur trioxide concentration is not substantially exceeded by the ammonia concentration at any location. We have further illustrated that the gaseous sulfur trioxide concentrations can be determined by acid dew point measurements.

While we have shown and described a present preferred embodiment of the invention and have illustrated a present preferred method of practicing the same, it is to be distinctly understood that the invention is not limited thereto but may be otherwise variously embodied and practiced within the scope of the following claims.

We claim:

1. An improved apparatus for injecting gaseous ammonia into a waste gas for enhancing the performance of a particulate collection device comprising:

(a) a source of gaseous ammonia;

(b) a manifold that receives a primary gaseous ammonia flow from said source of gaseous ammonia and splits said primary gaseous ammonia flow into a plurality of secondary gaseous ammonia flows;

(c) an array comprising a plurality of injectors for said secondary gaseous ammonia flows, said array located upstream from a particulate collection device through which said waste gases pass, wherein said array is located in a position to introduce varying feed rates of said secondary gaseous ammonia across said array into said waste gases;

d) one or more control valves to control said secondary gaseous ammonia flows to one or more injectors of said array;

e) one or more sensing devices to measure gas phase sulfur trioxide concentrations in a plurality of locations, wherein said one or more sensing devices are located downstream from said array and wherein each of said one or more sensing devices generates one or more output signals that are based upon the concentration of said gas-phase sulfur trioxide;

f) one or more controllers which receive said output signals and which generate one or more control signals to adjust one or more of said control valves such that said secondary gaseous ammonia flows from said array maintain the downstream concentration of sulfur trioxide at an optimum level.

2. The invention of claim 1, wherein said waste gas is generated by a combustion device.

3. The invention of claim 2, wherein said combustion device is a steam generator.

4. The invention of claim 2, wherein said combustion device is a cement kiln.

5. The invention of claim 2, wherein said combustion device is a heater.

6. The invention of claim 2, wherein said combustion device is an incinerator.

7. The invention of claim 1, wherein said one or more sensing devices comprise acid dew point temperature probes.

8. The invention of claim 1, wherein said one or more sensing devices comprise acid dew point temperature probes and a means for determining water vapor concentration.

9. The invention of claim 1, wherein said particulate collection device comprises an electrostatic precipitator.

10. The invention of claim 1, wherein said particulate collection device comprises a baghouse.

11. The invention of claim 1, wherein said particulate collection device comprises a cyclone.

12. The invention of claim 1, wherein said particulate collection device comprises a sand filter.

13. The invention of claim 1, wherein said particulate collection device comprises a pebble filter.

14. The invention of claim 1, wherein said particulate collection device comprises an electrified sand filter.

15. The invention of claim 1, wherein said particulate collection device comprises an electrified pebble filter.

16. The invention of claim 1, wherein said primary gaseous ammonia flow is diluted with a carrier gas.

17. The invention of claim 1, wherein said one or more injectors are arranged non-uniformly around a duct through which said waste gas flows.

18. The invention of claim 1 further comprising one or more spray nozzles located upstream of said one or more injectors, wherein said spray nozzles are used to provide additional sulfur trioxide.

19. An improved method for enhancing the performance of a particulate collection device comprises the steps of:

a generating a primary gaseous ammonia flow from an ammonia source;

(b) splitting said primary gaseous ammonia flow into a plurality of secondary gaseous ammonia flows;

(c) delivering said secondary gaseous ammonia flows to an array comprising a plurality of injectors;

(d) introducing said secondary gaseous ammonia flows into waste gas;

(e) measuring a gas-phase sulfur trioxide concentration of said waste gas in one or more locations downstream from said array;

(f) generating one or more output signals that are based upon the measurement of said gas-phase sulfur trioxide concentration as in step (e); and (g) controlling said secondary gaseous ammonia flows from said array in varying feed rates across said array to maintain downstream concentration of sulfur trioxide at an optimum level.

* * * * *